US010226811B2

(12) United States Patent
Sze

(10) Patent No.: US 10,226,811 B2
(45) Date of Patent: Mar. 12, 2019

(54) HAIR CLIPPING DEVICE

(71) Applicant: Tung Hing Plastic Manufactory Ltd., Kowloon (CN)

(72) Inventor: Ka Chuen Sze, Kowloon (CN)

(73) Assignee: Tung Hing Plastic Manufactory Ltd., Kowloon (CN)

( * ) Notice: Subject to any disclaimer, the term of this patent is extended or adjusted under 35 U.S.C. 154(b) by 0 days.

(21) Appl. No.: 15/459,859

(22) Filed: Mar. 15, 2017

(65) Prior Publication Data

US 2017/0181517 A1 Jun. 29, 2017

Related U.S. Application Data

(63) Continuation-in-part of application No. 14/606,470, filed on Jan. 27, 2015, now Pat. No. 9,642,431.

(30) Foreign Application Priority Data

Feb. 14, 2014 (GB) ..... 1402637.1

(51) Int. Cl.
*A45D 8/06* (2006.01)
*B21G 7/06* (2006.01)
(Continued)

(52) U.S. Cl.
CPC ..... *B21G 7/06* (2013.01); *A45D 8/14* (2013.01); *B21F 45/00* (2013.01)

(58) Field of Classification Search
CPC ... A45D 8/14; A45D 8/02; A45D 8/04; A45D 8/06; A45D 8/08; A45D 8/16; A45D 8/36;
(Continued)

(56) References Cited

U.S. PATENT DOCUMENTS 515,745 A 3/1894 Caldwell
562,690 A 6/1896 Young
(Continued)

FOREIGN PATENT DOCUMENTS

| | | |
|---|---|---|
| CA | 831304 | 1/1970 |
| GB | 425446 | 3/1935 |
| GB | 655918 | 8/1951 |

OTHER PUBLICATIONS http://www.amazon.com/Scunci-No-slip-Beautiful-Blends-48-Count/dp/130045HWN22/ref. (2011).

*Primary Examiner* — Rachel R Steitz
(74) *Attorney, Agent, or Firm* — Heslin Rothenberg Farley & Mesiti P.C.; Kristian E. Ziegler; Melvin S. Li

(57) ABSTRACT

The present disclosure provides a hair clip. The clip has a first leg portion and a second leg portion formed from a wire, the wire configured by bending such that the first and second leg portions are biased toward each other and at default lie in contact or at least adjacent to each other, and substantially parallel to each other, for securing hair therebetween. The wire is provided with a first coating of a paint material on an entire surface of the wire. Each of the first and second leg portions forms an outwardly facing surface and an inwardly facing surface, the first and second leg portions being provided with a second coating of an anti-slipping material only over the inwardly facing surface and on the first paint material coating such that the outwardly facing surface of the first and second leg portions is free of the anti-slipping coating.

17 Claims, 2 Drawing Sheets

(51) Int. Cl.
*B21F 45/00* (2006.01)
*A45D 8/14* (2006.01)

(58) Field of Classification Search
CPC ..... A45D 2007/002; B21G 7/06; B21G 7/00; B21G 7/02; B21G 7/04; B21F 45/00; B21F 45/16; B21F 9/00
See application file for complete search history.

(56) References Cited

U.S. PATENT DOCUMENTS

| | | | | |
|---|---|---|---|---|
| 706,036 | A | 8/1902 | Dun Lany | |
| 708,959 | A | 9/1902 | Harrison | |
| 1,272,209 | A | 7/1918 | Burke | |
| 1,410,948 | A | 3/1922 | Miller | |
| 1,834,153 | A | 3/1931 | Haims | |
| 1,994,248 | A * | 3/1935 | Hermsdorf ..... | A45D 8/14 132/284 |
| 2,070,939 | A | 2/1937 | Whitney | |
| 2,075,194 | A | 3/1937 | Clark | |
| 3,540,491 | A | 11/1970 | Solomon | |
| 3,915,203 | A | 10/1975 | Solomon | |
| 5,819,761 | A | 10/1998 | Sloan | |
| 8,307,835 | B2 | 11/2012 | King | |
| 2006/0021631 | A1 | 2/2006 | Lafauci | |
| 2006/0162046 | A1 | 7/2006 | Chudzik et al. | |
| 2006/0174909 | A1 | 8/2006 | Vestal et al. | |
| 2007/0256702 | A1 | 11/2007 | Traver et al. | |

* cited by examiner

HAIR CLIPPING DEVICE

CROSS REFERENCE TO RELATION APPLICATION

The present application claims Paris Convention priority from U.S. patent application Ser. No. 14/606,470 filed Jan. 27, 2015 which claims priority from GB1402637.1 filed Feb. 14, 2014, contents of all of which are incorporated herein in their entirety.

FIELD OF THE INVENTION

The present invention is concerned with a hair clipping device and in particular a hair clip.

BACKGROUND OF THE INVENTION

There are a variety of hair accessories in the market designed to suit different hair styling needs. For example, the market has provided conventional hair pins for use in expanding hair volume or allowing installation of ornaments or decorations on the hair. The market has also provided different types of conventional hair clipping devices for use in securing hair style. However, many such devices suffer from different problems. For example, some devices are easy to break, while some others are too complicated with many small mechanical parts (e.g. spring) and they tend to cause tangling of hair to these parts, and some are complicated to manufacture, making the commercially unsuccessful.

The present invention seeks to provide an improved hair clipping device to allow a user to secure hair effectively and reliably and yet to ensure easy removal of the devices when needed, or at least to provide the public with a useful alternative.

SUMMARY OF THE INVENTION

According to a first aspect of the present invention, there is provided a hair clip comprising a first leg portion and a second leg portion formed from a washed wire, the wire configured by bending such that at default the first and second leg portions lie in are biased against each other, for securing hair therebetween, wherein the wire is provided with a first coating of a paint material on an entire surface of the wire, wherein each of the first and second leg portions is provided with an outwardly facing surface and an inwardly facing surface, the first and second leg portions is provided with a second coating of an anti-slipping material only on the inwardly facing surface of the first and second leg portions and on the first paint material coating, and wherein the outwardly facing surface of the first and second leg portions is free of the anti-slipping coating.

Preferably, the hair clip may comprise a first region at which, when not in use, the first and second leg portions are in contact with each other. In an embodiment, when not in use, the first and second leg portions are in contact with each other only at the first region only. In one embodiment, the hair clip may comprise a second region at which the first and second leg portions are spaced apart from each other for accommodating a lock of hair therebetween. In a specific embodiment, at least one of the first and second leg portions at the second region may be configured to assume a zig-zag configuration.

Suitably, the anti-slipping coating may be made from a material selected from the group consisting of PVC, silicone, TPE, TPE foam, polyurethane, polyurethane foam and silicone-based paint.

Advantageously, the hair clip may comprise an enlarged ending at each of the first and second leg portions. The ending may be made of epoxy resin.

In a preferred embodiment, the wire may be made of a metallic material. The washed wire may be formed from a wire prior to application of the first paint material coating. The bent wire may be formed by punching such that the first and second leg portions extend substantially linearly.

BRIEF DESCRIPTION OF THE DRAWINGS

Some embodiments of the present invention will now be explained, with reference to the accompanied drawings, in which.

DETAILED DESCRIPTION OF PREFERRED EMBODIMENTS OF THE INVENTION

The present invention is generally concerned with a hair clipping device for securing hair or otherwise organizing hair.

Figure 1:
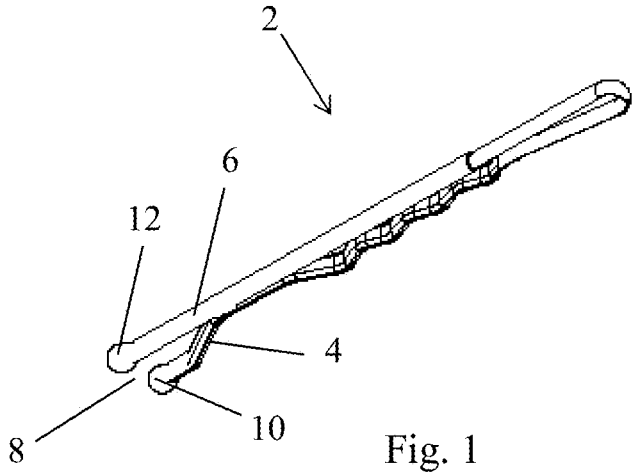
FIG. 1 is a perspective view of an embodiment of a hair clip according to the present invention.
Figure 2:
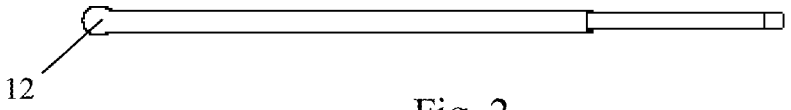
FIG. 2 is a bottom view of the hair clip of FIG. 1.

FIG. 1 shows an embodiment of a hair clipping device in the form of a hair clip according to the present invention. The hair clip is generally designated 2 and has an elongate body. The elongate body is made of a metallic wire 1 which is somewhat flattened such that the cross section of the wire roughly resembles an oval shape. Please see FIG. 4. Preferably, the metallic wire 1 is a washed wire. The hair clip 2 has a first leg portion 4 and a second leg portion 6. The hair clip 2 is formed with the wire 1 bent from an essentially straight profile to such that the first leg portion 4 and the second portion 6 are brought together. From FIG. 1, it is shown that both the first leg portion 4 and the second leg portion 6 extend linearly from a bent portion of the wire 1, and lie in contact with each other or at least adjacent each other, and are generally in parallel with each other.

Figure 3:
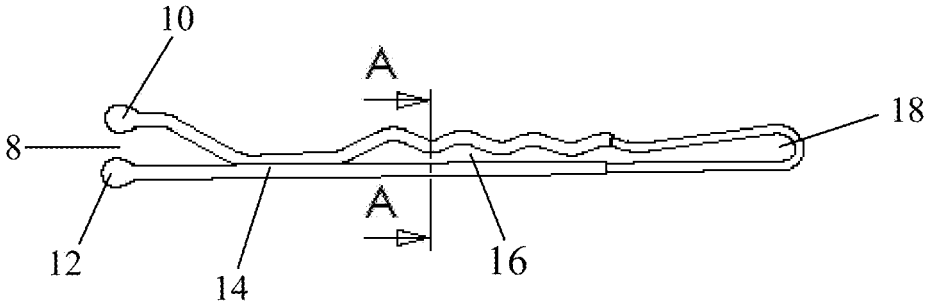
FIG. 3 is a side view of the hair clip of FIG. 1.

Referring to FIG. 3, it is shown that the hair clip 2 has an opening 8 defined by the endings 10, 12 of the first and second leg portions 4, 6. In use, the hair clip 2 is moved towards hair to be secured with the hair entering spacing between the first and second leg portions 4, 6 via the opening 8. In this embodiment, the endings 10, 12 are capped with enlarged and round members made of an epoxy resin to facilitate movement of the hair clip 12 in use. It can been seen from the figure that the hair clip 2 is provided with a first region 14 at which the first leg portion 4 and the second leg portion 6 are in contact with each other. This first region 14 is situated at or adjacent to the enlarged endings. The hair clip 2 is also provided with a second region 16 at which the first leg portion 4 and the second leg portion 6 are spaced apart from each other. In the second region 16, spacing is provided to accommodate hair that is secured therein. In this embodiment, the first leg portion 4 at the second region 16 is configured to assume a zig-zag profile. This profile enhances gripping of hair positioned between the first and second leg portions 14, 16. The hair clip 2 is provided with a third region 18 which acts as a hinge providing springy action for biasing the first and second leg portions 4, 6 towards each other.

Figure 4:
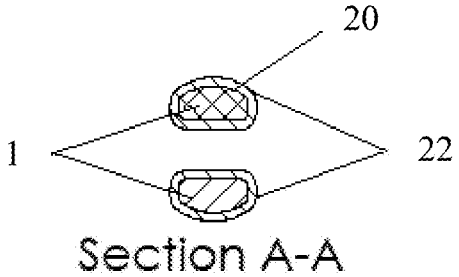
FIG. 4 is a cross section view of the hair clip of FIG. 3.
Figure 5:
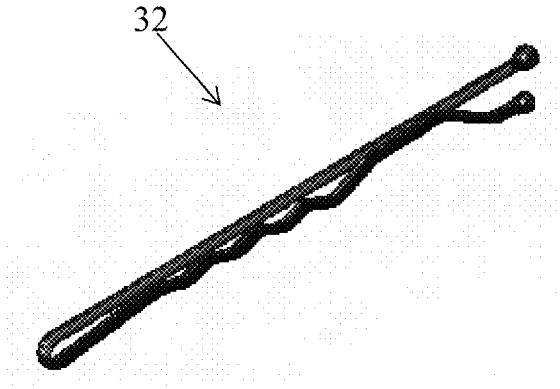
FIG. 5 is a perspective view of another embodiment of a hair clip according to the present invention.
Figure 6:
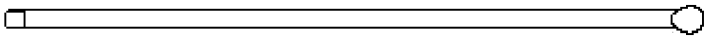
FIG. 6 is a bottom view of the hair clip of FIG. 5.
Figure 7:
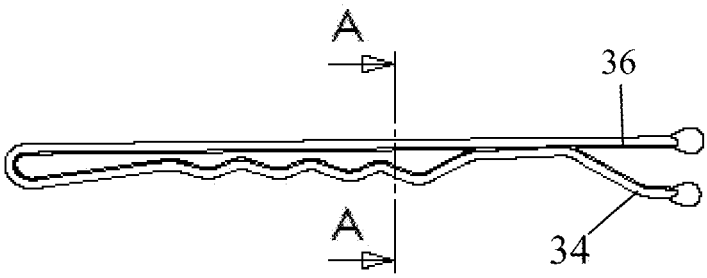
FIG. 7 is a side view of the hair clip of FIG. 5.
Figure 8:
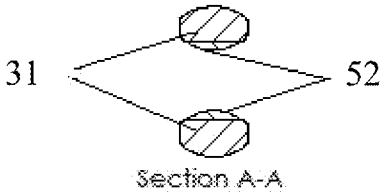
FIG. 8 is a cross section view of the hair clip of FIG. 5.

Referring to FIG. 4, it is shown that the hair clip 2 is provided with a first coating 20 adhered to the surface of the wire 1. This coating 20 is to provide desired coloring and protection to the hair clip 2.

Also referring to FIG. 4, the hair clip 2 is provided with a second coating 2 covering most of the surface of the first and second leg portions 4, 6. In other words, the second coating 22 covers both outwardly facing surface and inwardly facing surface of the first and second leg portions 4, 6. The second coating 22 is made of an anti-slipping material for minimizing movement of the hair clip 2 once fitted to a lock of hair. The anti-slipping coating may be made from a material selected from the group consisting of PVC, silicone, TPE, TPE foam, polyurethane, polyurethane foam and silicone-based paint.

FIG. 3 shows that the hinge portion 18 of the hair clip 2 is provided with the first coating 20 of paint but not the second coating 22 of anti-slipping material. This is because the hinge portion 18 does not serve to secure hair. Further, applying the second coating 22 to the hinge portion would interfere working of the hair clip 2 in use.

The hair clip 2 is made by firstly providing a wire 1 with circular cross section. The wire 1 is subjected to a flattening step. After flattening, the wire 1 is undergone washing which can assist coating of material thereon. Then the wire 1 is subjected to application of the first coating 20, followed by the second coating 22. The first coating 20 may be applied by spraying a paint thereon. The second coating 22 may be applied by dipping the wire into the anti-slipping material on opposite ends of the wire. After the second coating 22 has been dried, the coated wire is subjected to a punching step such that the wire forms into the shape of the hair clip 2 with the two legs situated next to each other.

FIGS. 5-8 show a second, and more preferable, embodiment of a hair clip 32 according to the present invention. The hair clip 32 as shown in FIGS. 5-8 is generally similar to the above hair clip 2 shown in FIGS. 1-4. One main difference is that a second coating 52 of anti-slipping material is applied on only an inwardly facing surface of the hair clip 32 and not on an outwardly facing surface of the hair clip 32. This is technically advantageous in use in a multi-fold manner. First, only hair secured between the two legs 34, 36 is subject to reaction of the anti-slipping coating, and as such is discouraged from unintentionally slipping away, and surrounding hair that is not to be secured can slide or otherwise move freely on the outwardly facing surface of the hair clip. Otherwise, orientation of the hair would be interfered by the outwardly facing surface of the hair clip. For example, an inner layer of hair may be tightly secured by the hair clip 32, and an outer layer of hair can cover the secured inner layer without having its natural movement be restricted the outwardly facing surface of the hair pin. Further, the inwardly facing surface of the coated wire has a convex surface. Second, the free of any anti-slipping coating at the upwardly facing surface would not change the paint or other aesthetic decoration on the outwardly facing surface. This is to be contrasted with different configurations in which anti-slipping coating is applied on entire circumferential surface of the legs. Application of anti-slipping coating on the entire circumferential surface of the legs would introduce excess friction such that it would interference to wearing or removal of the clips during use.

The method of manufacture of the hair clip is similar to that of the clip in 2, except the anti-slipping coating is applied only on the inwardly facing surface.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose.

The invention claimed is:

1. A hair clip comprising:

a first leg portion and a second leg portion formed from a wire for securing hair therebetween, the wire configured by bending such that at default the hair clip includes a first region wherein the first and second leg portions lie in contact with each other, extend linearly and parallel to each other, and are biased against each other, and a second region wherein at least one of the first and second leg portions extends non-linearly, wherein the wire is provided with a first coating of a paint material on an entire surface of the wire, wherein each of the first and second leg portions includes an outwardly facing surface and an inwardly facing planar surface, the first and second leg portions of the first region being provided with a second coating of an anti-slipping material only on the inwardly facing planar surfaces thereof over the first coating, the second coating forming a convex inner surface profile in cross-section that extends across the respective first and second leg portions, and wherein the outwardly facing surface of the first and second leg portions of the first region is free of the second coating.

2. A hair clip as claimed in claim 1, wherein, when the hair clip is not in use and at default, the first and second leg portions are in contact with each other only at the first region.

3. A hair clip as claimed in claim 1, wherein the first and second leg portions of the second region are spaced apart from each other for accommodating a lock of hair therebetween.

4. A hair clip as claimed in claim 3, wherein at least one of the first and second leg portions at the second region assumes a zig-zag configuration.

5. A hair clip as claimed in claim 4, wherein the first leg portion of the second region assumes a zig-zag configuration and the second leg portion of the second region extends linearly.

6. A hair clip as claimed in claim 1, wherein the anti-slipping material is made from a material selected from the group consisting of PVC, silicone, TPE, TPE foam, polyurethane, polyurethane foam and silicone-based paint.

7. A hair clip as claimed in claim 1, comprising an enlarged ending at each of the first and second leg portions.

8. A hair clip as claimed in claim 7, wherein the ends of the first and second leg portions at the enlarged ending include round members made of epoxy resin.

9. A hair clip as claimed in claim 1, wherein the wire is made of a metallic material.

10. A hair clip as claimed in claim 9, wherein the wire is a washed wire prior to application of the first paint material coating.

11. A hair clip as claimed in claim 10, wherein the bent wire is formed by punching to form the first and second leg portions.

12. A hair clip as claimed in claim 1, wherein the first coating is of a constant thickness.

13. A hair clip as claimed in claim 1, wherein the outer surfaces of the first coating on the inwardly facing planar surfaces of the first and second leg portions are planar.

14. A hair clip as claimed in claim 1, wherein the thickness of the second coating varies in cross-section.

15. A hair clip as claimed in claim 14, wherein the first coating is of a constant thickness.

16. A hair clip as claimed in claim 1, wherein the outwardly facing surfaces of the first and second leg portions form a convex outer surface profile in cross-section.

17. A hair clip as claimed in claim 16, wherein the first coating is of a constant thickness.

* * * * *